US011788229B2

(12) United States Patent
Kauppinen

(10) Patent No.: US 11,788,229 B2
(45) Date of Patent: Oct. 17, 2023

(54) MONITORING AND CONTROLLING OF REFINING OF FIBROUS PULP

(71) Applicant: Valmet Technologies Oy, Espoo (FI)

(72) Inventor: Lasse Kauppinen, Espoo (FI)

(73) Assignee: Valmet Technologies, Inc., Espoo (FI)

( * ) Notice: Subject to any disclaimer, the term of this patent is extended or adjusted under 35 U.S.C. 154(b) by 499 days.

(21) Appl. No.: 16/865,324

(22) Filed: May 2, 2020

(65) Prior Publication Data

US 2020/0347551 A1 Nov. 5, 2020

(30) Foreign Application Priority Data

May 3, 2019 (FI) ..... 20195363

(51) Int. Cl.

| | |
|---|---|
| ***D21D 1/20*** | (2006.01) |
| ***D21D 1/00*** | (2006.01) |
| ***D21H 11/18*** | (2006.01) |
| ***D21H 11/20*** | (2006.01) |

(52) U.S. Cl.

CPC ..... *D21D 1/002* (2013.01); *D21D 1/20* (2013.01); *D21H 11/18* (2013.01); *D21H 11/20* (2013.01)

(58) Field of Classification Search

CPC ..... D21D 1/002; D21D 1/20
USPC ..... 162/49
See application file for complete search history.

(56) References Cited

FOREIGN PATENT DOCUMENTS

| | | | |
|---|---|---|---|
| EP | 2014828 | A1 | 1/2009 |
| JP | 2013186034 | A | 9/2013 |
| WO | 9915877 | A1 | 4/1999 |

OTHER PUBLICATIONS

Laitinen, O. et al. PaperAge, Mar./Apr. 2017, pp. 34-36, http://www.paperage.com/issues/march_april2015/PaperAge_MarchApril2015.pdf, retrieved Apr. 9, 2020.

Kang, T. et al. "Recycle Potential of Externally Fibrillated Chemical Pulp", Paper Recycling [online], Feb. 2006, vol. 15, No. 2, pp. 11-17, https://aaltodoc.aalto.fi/bitstream/handle/123456789/2902/article6.pdf?sequence=7&isAllowed=y, retrieved Apr. 9, 2020.

FINNISH Search Report for U.S. Appl. No. 20/195,363.

*Primary Examiner* — Jacob T Minskey
(74) *Attorney, Agent, or Firm* — Stiennon & Stiennon

(57) ABSTRACT

The refining of a fibrous pulp is monitored and controlled by capturing at least one image of a pulp sample, determining the amount of all fibers or non-fibrillated fibers in the at least one image, determining the amount of fibrillated fibers in the at least one image, determining the relation between fibrillated fibers and all fibers or non-fibrillated fibers in the pulp on the basis of the amount of fibrillated fibers and the amount of all fibers or non-fibrillated fibers in the at least one image, generating a control parameter on the basis of the determined relation between fibrillated fibers and all fibers or non-fibrillated fibers in the pulp, and controlling fiber refining by at least one pulp refining device on the basis of the control parameter.

9 Claims, 5 Drawing Sheets

MONITORING AND CONTROLLING OF REFINING OF FIBROUS PULP

CROSS REFERENCES TO RELATED APPLICATIONS

This application claims priority on Finnish App. No. FI 20195363, filed May 3, 2019, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to monitoring and controlling of the refining of a fibrous pulp.

Refining of pulp is one of the most important stages in the paper, board or tissue making process. Refining has an effect on operation and energy consumption of the paper, board or tissue machine and the chemical dosing strategy. It also determines the quality and final properties of an end product, such as strength and printability. Thus, numerous tests such as fiber length, diameter, modulus and strength, freeness and chemical purity measurements, can be conducted on the pulp fibers to predict and modify properties of the end product. However, there is still a need to improve the determining of fiber properties and controlling of fiber modification and chemical dosing for higher quality paper, board, tissue, and microfibrillated, nanofibrillated and nanocrystalline cellulose.

SUMMARY OF THE INVENTION

The invention captures at least one image of a pulp sample and determines the amount of all fibers or non-fibrillated fibers in the image and determines the amount of fibrillated fibers in the image. A relationship is determined between fibrillated fibers, and all fibers or non-fibrillated fibers in the image. A control parameter is determined by the relationship between fibrillated fibers and all fibers or non-fibrillated fibers in the pulp and fiber refining is controlled in at least one pulp refining device on the basis of the control parameter. Fiber modification by the at least one pulp refining device is done on the basis of the control parameter.

An apparatus captures the at least one image of a pulp sample and determines the amount of all fibers or non-fibrillated fibers in the image and determines the amount of fibrillated fibers in the image. The apparatus determines the relationship between fibrillated fibers and all fibers or non-fibrillated fibers in the image. The apparatus uses a control parameter determined by the relationship between fibrillated fibers and all fibers or non-fibrillated fibers in the pulp to control fiber refining by at least one pulp refining device.

According to an embodiment, the pulp sample is a pulp liquid suspension.

According to an embodiment, the controlling fiber refining comprises controlling further processing of the pulp batch being analyzed and refined into a further or a recurrent refining stage or to a subsequent process stage after the pulp refining.

According to an embodiment, the apparatus is provided before a headbox in a paper; board or tissue machine.

According to an embodiment, pulp refining is controlled for microfibrillated, nanofibrillated and nanocrystalline cellulose manufacturing process.

According to an embodiment, internal fibrillation is analyzed on the basis of the relation between fibrillated fibers and at least one of: all fibers, non-fibrillated fibers in the pulp, and by energy used in the refining of the pulp.

According to an embodiment, the apparatus is configured to generate the control parameter further on the basis of at last one of: the Canadian standard freeness parameter and the Schopper Riegler parameter.

DESCRIPTION OF THE PREFERRED EMBODIMENTS

In the present context, the term "pulp" includes but is not limited to pulps made from softwood, hardwood or non-wood fibers, and recycled pulps made from printed waste papers such as newspapers, advertising leaflets, magazines, data recording papers, photocopies, computer printouts or mixtures of these printed matters such as waste magazine papers and office waste papers as well as mixtures thereof. The term also comprises microfibrillated (MFC), nanofibrillated (NFC) and nanocrystalline (NCC) cellulose, synthetic pulp and artificial pulp.

In the present context, the term "fibrillation" comprises the shearing of pulp fibers to loosen fibrils from the fiber surface and fiber wall by external fibrillation and/or delamination and swelling of fibers by internal fibrillation.

In the present context, the term "fibrillated fiber" comprises fibers that have been processed to develop fibers with a higher surface area and/or branched structure.

In the present context, the term "refining" comprises mechanical and/or chemical treatment for fibrillation of the fibrous pulp.

In the present context, the term "chemical fibrillation" comprises chemical treatment for fibrillation of the fibrous pulp.

In the present context, the term "approach flow system" comprises the part of the papermaking process between the final stock preparation storage tanks and the headbox of the paper machine.

During refining of a pulp, fibrillation of cellulose fibers takes place. Fibrillation is one of the most important fiber properties for controlling properties of an end product. For example, it has been noted that fibrillated fibers give more strength to the end product by stronger fiber to fiber bonding by the increased bond area of the fibers. In addition, studies with functional paper chemicals have shown that chemicals tend to attach more fines and fillers for more fibrillated fibers and microfibrillated, nanofibrillated and nanocrystalline cellulose. Thus, it is important to measure fiber properties, particularly fibrillation, for controlling refining, optimizing chemical dosing strategy, and modelling strength and other mechanical properties of the end product. However, there is still a need for improved determining and controlling of the fibrillation. Thus, the present embodiments provide an improved method for monitoring and controlling refining of a fibrous pulp.

Figure 1:
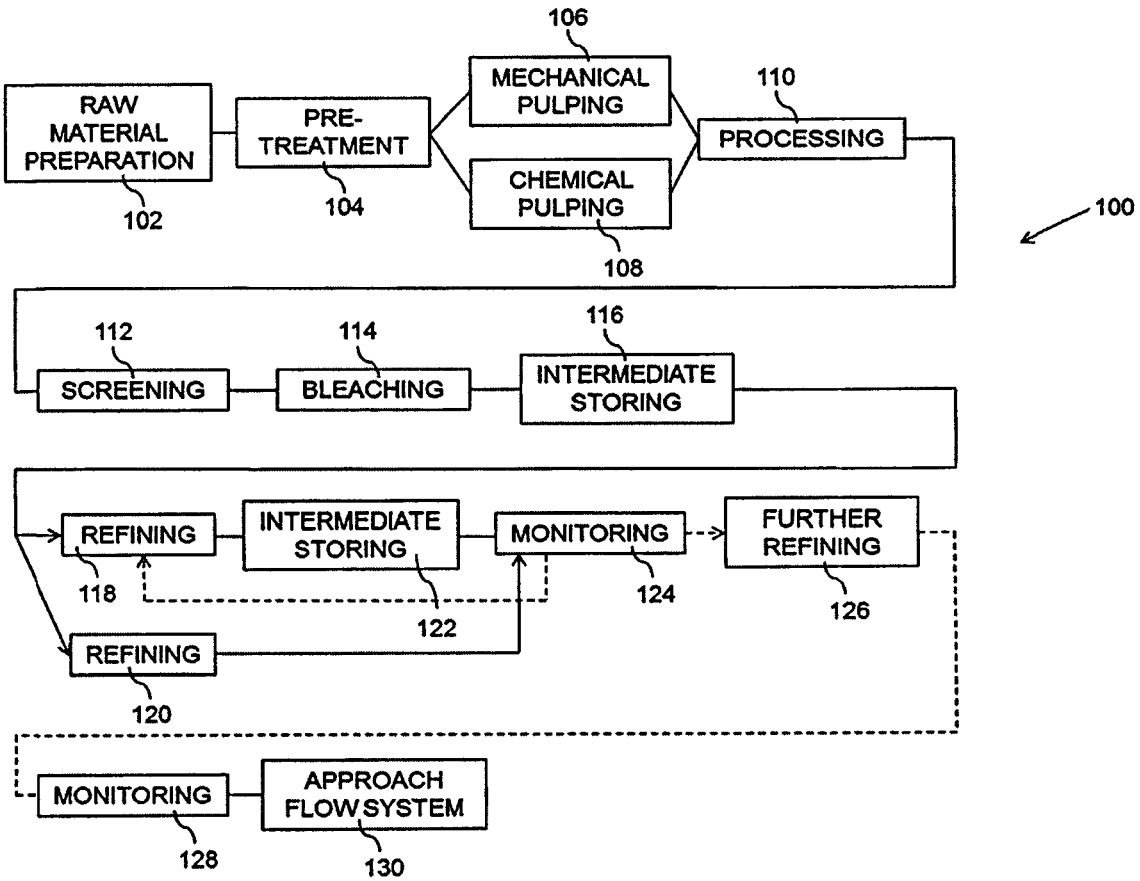
FIG. 1 illustrates a pulp manufacturing process in accordance with at least some embodiments of the present invention.

FIG. 1 illustrates a pulp manufacturing process 100. The process may comprise raw material preparation 102, pretreatment 104, mechanical or chemical pulping 106, 108, processing 110, screening 112 and bleaching 114 of the pulp, intermediate storing 116, 122 of the pulp, refining 118, 120 of the pulp, monitoring 124 of the pulp, and further refining 126 of the pulp.

The pulp may be again monitored 128 after the further refining 126. The pulp may be provided for further process stages. In the example of FIG. 1, the pulp is provided to an approach flow system (AFS) 130. Approach flow system steps 130 may comprise for example, a headbox of a paper, board or tissue machine, a mixing tank, a machine tank, a chemical treatment or a steam explosion system. It should be appreciated that FIG. 1 illustrates only one example of the pulp manufacturing process and at some of the stages may be different or even omitted. The pulp manufacturing process may also comprise other process stages, such as pre- and post-treatments and intermediate storing of the pulp. Furthermore, refining and monitoring may be carried out at several stages.

The raw material preparation 102 may comprise for example, debarking, chipping, cooking, bleaching, screening and washing of the raw material. In chipping, the logs (or portions of logs) are reduced to chip fragments suitable for the subsequent pulping operations. Screening may segregate chips on the basis of chip length and/or thickness.

Mechanical or chemical pulping 106, 108 is used to disintegrate wood (or other fibrous raw material) into individual cellulose fibers. The mechanical pulping methods use mechanical energy to weaken and separate fibers from wood via a grinding action. Mechanical pulping methods comprise for example, groundwood (GW), refiner mechanical (RMP), thermomechanical (TMP) and chemi-thermomechanical (CTM) pulping. Chemical pulping breaks down the bulk structure of the fiber source by degrading the lignin and hemicellulose into small, water-soluble molecules which can be washed away from the cellulose fibers. Chemical pulping methods comprise for example, the kraft process and sulfite process.

After pulp production, pulp processing 110 removes impurities, such as uncooked chips, and recycles any residual cooking liquor via the pulp washing process. Screening 112 of the pulp is done to remove oversized and unwanted particles such as knots and shives. Then, the pulp may be bleached to get lighter color. Bleaching 114 may be also used for purification of the pulp by removing hemicelluloses and wood extractives as well as lignin.

Pulp produced in a pulp mill without any mechanical treatment is usually unsuitable for most paper grades. Thus, refining 118 is conducted for achieving better pulp quality. In the refining process, fibers become fibrillated by external fibrillation as outer portions of the fibers are peeled at least partly. Some of the outer portions of the fibers may stay attached and increase the strength of the fiber. This significantly increases the surface area of the fibers. In addition, the inner wall may become delaminated by internal fibrillation which increases the conformability, flexibility, bonding tendency and thickness of the fibers. Due to internal fibrillation, larger fiber-to-fiber bonding surface and more bulk is obtained. In addition, dewatering is more effective due to lower amounts of fines and the need for drying energy is reduced.

Refining 118 may be carried out by for example, a beater or a refiner, such as a single disc refiner, a conical disc refiner, a double disc refiner or a flat disc refiner. The refiner may comprise two blades facing and rotating relative to one another creating the mechanical action of refining.

Referring to FIG. 1, the refining process may comprise simultaneous refining 120 and/or further refining 126 stages. In the simultaneous refining, the pulp flow may be divided and guided to at least two refiners which refine the fibers at the same time. Refining may comprise for example, 1-10 stages, especially 1-5 stages, preferably 1-3 stages. Refining stage(s) can be repeated to generate fibrillated fibers. Refining may be monitored and controlled to achieve preferred fiber properties. The pulp can be guided to a further or back to recurrent refining stage on the basis of a fiber monitoring 124 to achieve preferred fiber properties. For example, after the fiber monitoring 124, the fibers may be guided to previous refining 118 stage or further refining 126 stage. The fibers may be guided through the same refining stage several times, even up to 20-30 times. Then, the fibers may be guided again to the fiber monitoring 124. The fiber monitoring and previous or further refining stages may be repeated until the preferred fiber properties are achieved. When the preferred fiber properties are achieved, the pulp may be provided to a further process steps.

In the following examples, the term fibrillated fibers proportion parameter is used to refer to the relation between fibrillated fibers and all fibers or non-fibrillated fibers in the pulp.

Figure 2:
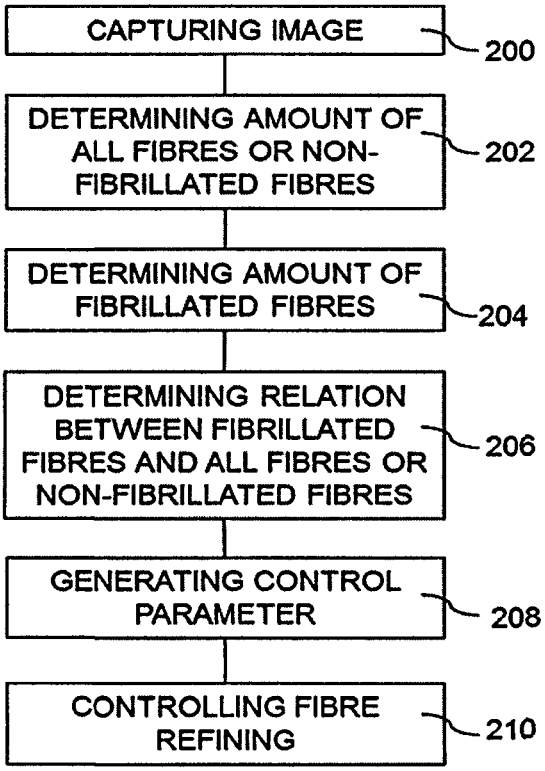
FIG. 2 illustrates a method for monitoring and controlling of refining of the fibrous pulp in accordance with at least some embodiments of the present invention.

FIG. 2 illustrates the method for monitoring and controlling of refining of the fibrous pulp. The method may comprise capturing 200 at least one image of a pulp sample, determining 202 the amount of all fibers or non-fibrillated fibers in the at least one image, determining 204 the amount of fibrillated fibers in the at least one image, determining 206 the relation between fibrillated fibers and all fibers or non-fibrillated fibers in the pulp on the basis of the amount of fibrillated fibers and the amount of all fibers or non-fibrillated fibers in the at least one image, generating 208 a control parameter on the basis of the determined relation between fibrillated fibers and all fibers or non-fibrillated fibers in the pulp, and controlling 210 fiber refining by at least one pulp refining device on the basis of the control parameter. Due to monitoring and controlling of refining of the fibrous pulp the smooth operation of the paper, board or tissue machine can be achieved, and final properties of the pulp or the end product can be adjusted. In addition, a chemical dosing strategy can be optimized and strength and other mechanical properties of the end product can be modelled according to the determined fibrillated fibers proportion parameter.

In addition to the determined relation between fibrillated fibers and all fibers or non-fibrillated fibers in the pulp, the method may be configured to generate 208 the control parameter further on the basis of Canadian standard freeness (CSF) parameter and/or S chopper Riegler (SR) parameter. CSF and SR parameters give a measure of the drainability of a pulp suspension in water. CSF parameter may be measured according to standards TAPPI T227 and ISO 5267-2. SR parameter may be measured according to standard 5267-1. Moreover, other inputs may be used to generate the control parameter 208.

It is noted that since the method of FIG. 2 may be implemented in an apparatus separate from imaging device, block 200 may refer to receiving image data of the pulp sample.

Controlling 210 fiber refining may comprise for example, adjusting a blade gap between segments in a refiner. The space between the blades can be widened or shortened, depending on the extent of refining appropriate to the end-use of the pulp, paper, board or tissue to be produced. The blade gap can be measured by at least one sensor or indirectly from refiner vibration or other indicative measurement.

The blade gap between the segments in the refiner has a major impact on both the production rate as well as the pulp quality. In addition, an optimal blade gap lowers refiner lifecycle costs due to fewer production stops and better refiner performance. Therefore, it is of great importance that the refiner runs with the optimal blade gap.

In addition, controlling 210 fiber refining may comprise controlling further processing of the pulp batch being analyzed and refined into a further or a recurrent refining stage or to a subsequent process stage after the pulp refining. The refining stages may be repeated until the pulp fulfils set requirements. Fibrillated fibers proportion parameter and other fiber properties can be determined before and/or after every refining stage.

Controlling 210 fiber refining may also comprise controlling changing blades of the refiner. The blades may be changed according to an indication generated on the basis of the fibrillated fibers proportion parameter. Blades with different patterns may be used for different stages of refining. The optimal selection of the blades provides preferred fiber properties and may reduce the need for several refining stages.

Moreover, controlling 210 fiber refining may comprise controlling of dilution water. An increase of dilution water intake reduces the pulp consistency. When operating at undesirably high dilution water intake, high pulp flow inside of the segments of the refiner may occur. This can lead to low pulp quality due to short refining time inside the segments and low specific energy input. On the contrary, decrease in dilution water intake gives higher consistency. This can lead to a lowering of intensity due to inadequate pulp flow between the segments, causing inadequate pulp quality and plugging of the segments. Thus, controlling of dilution water is important for achieving optimal fiber properties and pulp flow.

Controlling 210 fiber refining may also comprise controlling production volume. Production volume may be controlled by a feeder screw or a pump. Production volume impacts on retention time of the pulp and the pulp and steam flow. Thanks to optimal production volume, the refiner is stabilized due to even inflow of the pulp.

According to some embodiments, controlling 210 fiber refining may comprise controlling chemical treatment for chemical fibrillation of the fibrous pulp on the basis of the control parameter. The controlling chemical treatment may comprise controlling of dosage and/or duration of application of chemicals, controlling enzymatic treatment, controlling of dispersant treatment, controlling of solvent treatment, controlling of chemical additive or agent treatment to promote or enhance hydrolysis of cellulose, controlling of post-refining treatment, controlling retention chemical treatment and/or controlling amount of water. Chemicals may comprise for example, retention chemicals, polyacrylamide (PAM), silica and chemicals used in MFC or NFC production, such as 2,2,6,6-tetramethylpiperidine-1-oxyl (TEMPO). Enzymes may comprise for example, cellulase, xylanase, laccase and lipase.

The controlling of dosage of chemicals may be used as pre-treatment for refining and/or after and/or between the stages of mechanical refining. Chemicals may be dispensed directly to a pulp container, during process stages or in the approach flow system. Chemicals may be dispensed after pulping or after a preliminary refining in MFC or NFC process. Dispensing PAM and silica may be carried out for example, in a short circulation of a paper machine. Dispensing of the retention chemicals may be carried out for example, in the approach flow system.

The duration of application and dosage of the chemicals may be optimized to reach a preferred ratio of fibrillated fibers. The dosage of chemicals may be controlled to form indurated fibers and for softening of the upper layer of the fibers. Chemicals may increase internal fibrillation of the fibers by delamination, wherein a wall of the fiber thickens when the walls of the fibers are separated. Controlling dosage of chemicals produces fibers with optimal properties such as strength. In addition, enzymatic pre-treatment for refining may improve efficiency of refining process.

Before pulp monitoring 124 and determining of properties of the fibers, a pulp sample is prepared. The sample preparation may be manual or automatic. The pulp sample may be a pulp liquid suspension, such as a pulp water suspension. The pulp sample properties, such as weight and volume of the sample, may be determined before controlling of a consistency of the sample and determination of the fiber properties of the sample. The consistency of the pulp liquid suspension may be controlled for example, by adding a sufficient amount of liquid, such as water, to the suspension. A wetting agent may be added to the suspension to improve uniform distribution of the fibers in the suspension. The wetting agent may be for example, a surfactant or an alcohol.

Figure 3:
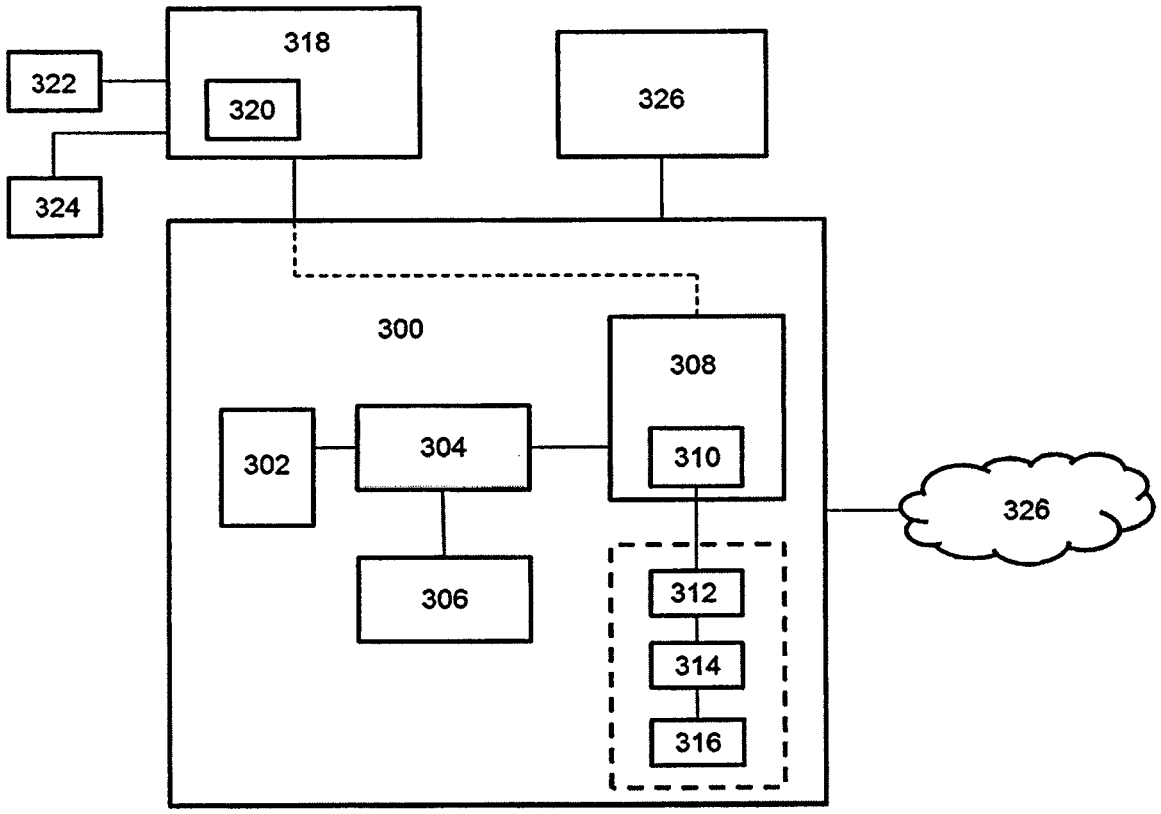
FIG. 3 illustrates an apparatus for monitoring and controlling of refining of the fibrous pulp in accordance with at least some embodiments of the present invention.

The amount of the fibrillated and/or all fibers may be determined 202, 204 by a fiber classifier, such as the fiber classifier 314 illustrated in the apparatus of FIG. 3, configured to: detect fibers and fibrils of fibers in the at least one image, and classify the detected fiber as a fibrillated fiber in response to fibrils connected to the fiber reaching a predetermined threshold parameter. The fiber classifier may be a part of the apparatus or connected to the apparatus. The predetermined threshold parameter may be set for example, according to the type of pulp used or input material type, such as tree species. The predetermined threshold parameter may be for example one to three fibrils, especially one fibril. Due to the fiber classification, fibrillated fibers proportion parameter in the pulp may be determined.

According to some embodiments, an object recognized in the at least one image may be classified as a fiber or a fibril on the basis of determined length and/or width of the object. The object may be classified as a fiber if the length of the object is for example, in the range of 0.5 to 15 mm, and/or if the width of the object is for example, in the range of 10 to 75 μm. The object may be classified as a fibril if the width of the object is for example, under 10 μm. The object may be classified as MFC or NFC fiber if the length of the object is for example, in the range of 100 nm to 100 μm, and/or if the width of the object is for example, in the range of 10 to 100 nm. The object may be classified as MFC or NFC fibril if the width of the object is for example, under 10 nm, especially in the range of 5 to 6 nm. The predetermined threshold parameters for width and length of the fibers and the fibrils may be set for example, according to the used pulp type or tree species. Classification may be done by determining length and/or width of the object in at least one image by the fiber classifier 314. Due to the fiber classification, fibrillated fibers proportion parameter may be determined.

An object recognized in the at least one image may be classified as a fiber or a fibril on the basis of determined area of the object. Classification may be done by detecting the objects and determining the area of the objects in at least one image by the fiber classifier 314. The predetermined threshold parameter(s) for area of the fibers and the fibrils may be set for example, according to the used pulp type or tree species.

According to some embodiments, a fiber recognized in the at least one image may be classified into the non-fibrillated fiber or the fibrillated fiber on the basis of a determined area or a determined circle of the fiber. Classification may be done by determining the area or the circle of the fiber in at least one image by the fiber classifier 314. Due to the fiber classification, fibrillated fibers proportion parameter may be determined.

After the fiber classification, fibrillated fibers proportion parameter in the at least one image may be determined. Determination may be conducted by calculating the ratio of the fibrillated fibers by using the following ratio equation:

$$\text{Fibrillated fibers proportion parameter} = \frac{\text{Amount of measured fibrillated fibers}}{\text{Amount of measured fibers or non-fibrillated fibers}} \times 100\%$$

The above mentioned new parameter for measuring fiber properties gives a useful tool for controlling refining, modelling paper, board or tissue strength and other mechanical properties and optimizing chemical dosing strategy. Due to the parameter, refining of the pulp may be controlled to adjust the ratio of the fibrillated fibers to achieve preferred pulp and/or end production properties. As compared to controlling a fibrous pulp process on the basis of fibrillation index based on surfaces or perimeters of fibers and fibrils, controlling fiber refining on the basis of the present ratio enables more accurate control of the refining and the pulp properties, because the effect of the non-fibrillated fibers on the pulp or end product properties can also be taken into account. For example, the fibrillated and non-fibrillated fibers may have different chemical treatment response. Thus, detecting also non-fibrillated fibers and calculating the fibrillated fibers proportion parameter is essential for achieving for example, optimal pulp properties in MFC, NFC and NCC manufacturing, and higher web strength, lower porosity, higher smoothness and higher gloss in paper manufacturing. The present fibrillated fibers proportion parameter is also essential in optimizing of amount of non-fibrillated fibers for achieving sufficient water removal properties.

The method of FIG. 2 may be provided before, after and/or during the paper, board or tissue making process. The method may be provided for example, after chemical or mechanical pulping 106, 108, and before and/or after refining 118, 120, 126. Thus, the method may give useful information about fiber properties in various stages of the paper, board or tissue making process and the process may be controlled according to the fiber properties to achieve an end product with optimal properties.

The method of FIG. 2 may be provided before a headbox in a paper, board or tissue machine rather than waiting for time-delayed laboratory tests done after paper, board or tissue manufacturing. Thus, the method may give useful information about fiber properties before web formation and fiber refining may be controlled according to the fiber properties to achieve an end product with preferred properties.

The pulp refining may be controlled for MFC, NFC and NCC manufacturing process. Thus, the method may give useful information about fiber properties during cellulose manufacturing and before formation of a product comprising cellulose. Moreover, MFC, NFC and NCC fiber refining may be controlled according to the fibrillated fibers proportion parameter to achieve MFC, NFC and NCC or a MFC, NFC and NCC product with preferred properties.

The process may be configured to generate 208 the control parameter further on the basis of internal fibrillation. In some embodiments, the internal fibrillation may be analyzed on the basis of the relation between fibrillated fibers and all fibers or non-fibrillated fibers in the pulp and/or by energy used in the refining of the pulp. The fiber may be classified as an internally fibrillated fiber if the width of the fiber reaches a predetermined threshold value. The amount of the internal fibrillation may increase when energy consumption increases in the refining process. Thus, internal fibrillation may be controlled by the fibrillated fibers proportion parameter and/or the energy consumption to achieve an end product with preferred properties.

FIG. 3 illustrates an apparatus 300 for monitoring and controlling of refining of fibrous pulp, the apparatus configured for at least performing: capturing at least one image of the pulp sample, determining the amount of all fibers or non-fibrillated fibers in the at least one image, determining the amount of fibrillated fibers in the at least one image, determining the relation between fibrillated fibers and all fibers or non-fibrillated fibers in the pulp on the basis of the amount of fibrillated fibers and the amount of all fibers or non-fibrillated fibers in the at least one image, generating a control parameter on the basis of the determined relation between fibrillated fibers and all fibers or non-fibrillated fibers in the pulp, and causing control of fiber modification by at least one pulp refining device on the basis of the control parameter. It is to be appreciated that FIG. 3 illustrates only one example of an applicable apparatus for monitoring and controlling of refining of fibrous pulp.

The apparatus may comprise or be connected to network(s) 326. Thus, the refining may be monitored and controlled fast and accurately already during the refining.

A pulp sample may be prepared in a sample handling unit 302 of the apparatus 300. The sample handling unit may comprise a plurality of automatic samplers for example, 1 to 20 samplers, especially 12 samplers. The pulp sample properties, such as weight, volume and pH of the sample, may be measured and the pulp sample may be prepared for imaging by the sample handling unit. Consistency of the pulp sample may be controlled by adding a sufficient amount of liquid, such as water, to the suspension.

The pulp samples may be taken at several points of the pulp stock for example, 1 to 20 points. The measurement cycle time may be for example, 0.5 to 10 minutes, preferably 3 to 6 minutes.

The means for capturing at least one image of the pulp sample may comprise an imaging module 304. The imaging module device may include a recording device that can record images in a digital format. The imaging module may capture for example, 30 to 70 frames/s. The size of the image may be for example, 30*20 mm, 8*6 mm for a high-definition (HD) image, and 16*13 mm for an ultra-high-definition (UHD) image.

The apparatus may comprise also further modules or units, such as a freeness measuring module 306. The main goal of freeness control is to produce a pulp that drains consistently and runs well on the paper, board or tissue machine. Consistency of the sample may be controlled automatically. Freeness of the pulp may be measured according to Canadian standard freeness method (CSF) described in standards TAPPI T227 and ISO 5267-2. In addition, Schopper Riegler (SR) parameter may be measured according to standard 5267-1 in the freeness module.

The images may be processed by image processing software after the image capturing. Image processing may comprise for example, filtering, noise reduction, changing of sharpness, brightness, and/or contrast of the images and/or color adjustment of the images. Image processing aids in detection of the objects and in fiber classification.

The apparatus 300 or the imaging module 304 may also comprise illuminating means to assist in the capture of images of the fibers. The illuminating device may for example comprise a lighting device such as a light emitting diode (LED) or an organic light emitting diode (OLED) light. The illuminating device may be positioned such that light is transmitted through the sample. On the other hand, the illuminating device may be positioned such that light is reflected from the samples. The illumination device aids the imaging module 304 in image capturing and the fiber classifier 314 in detection of the objects and in fiber classification.

The fiber analyzer which may comprise a fiber analysis module 308 determines the amount of all fibers or non-fibrillated fibers in the at least one image and determines the amount of fibrillated fibers in the at least one image. The fiber analysis module 308 may be a part of the apparatus 300 or connected to the apparatus. The fiber analysis module 308 may comprise a fibrillation analyzer 310, which may comprise or may be connected to a fiber detector 312, a fiber classifier 314, and a fibrillation relation parameter generator 316 generating fibrillated fibers proportion parameter of the at least one image by calculating the ratio of the fibrillated fibers by using the ratio equation.

The sample may be automatically diluted to the set consistency which may depend on the type of the pulp. After that, the sample suspension may flow as a continuous flow through the imaging module 304. Images may be taken from the sample flow at regular intervals during a predetermined time until the image number or a selected confidence interval calculation is achieved. Various objects may be identified and counted by fiber detector 312 from the captured images, such as fiber dimensions, fine particles, fiber fibrillation, fiber bundles; tube cells, and/or sticks. The fiber classifier 314 may classify fibers by automated computer image analysis. Suitable algorithms stored in the computer may enable the fiber classifier to determine dimensions of the objects detected in at least one image. The image analysis is a quick and reliable method for determining the fibers. The amount of the non-fibrillated fibers and fibrillated fibers may be counted by the fiber classifier 314 of the fibrillation relation parameter generator 316. Finally, the fibrillation relation parameter generator 316 may determine the fibrillated fibers proportion parameter.

The fiber analysis module 308 may be used for determining also other properties of the fibers such as details of fines, kink, curl, size distribution, fractions, and hardwood and softwood ratio. The determination of fibrillated fibers proportion parameter, possibly combined with other fiber properties measured by the apparatus, can be processed in a modeling tool that helps to predict how fiber properties will affect final sheet properties.

The apparatus 300 and/or the fiber analysis module 308 may comprise a processor, a communications unit and a memory. The fiber analysis module may comprise a transmitter and/or receiver, which may be configured to operate in accordance with a global system for mobile communication, GSM, wideband code division multiple access, WCDMA, long term evolution, LTE, 5G or other cellular communications systems, wireless local area network, WLAN, and/or Ethernet standards, for example.

The memory may store computer program code and parameters for causing the fiber analysis module 308 to perform at least some of the presently disclosed features, such as determining fibrillated fibers proportion parameter and at least some of the other features of FIG. 2, when the computer program code is executed by the processor. The memory, processor and computer program code may thus be the means to cause the fiber analysis module to perform at least some of the presently disclosed features related to the new fibrillated fibers proportion parameter.

The means for generating a control parameter on the basis of the determined fibrillated fibers proportion parameter may comprise a process controller 318. The process controller may comprise a refining controller 320 for generating the control parameter(s) 208 and/or controlling 210 the refining process by applying at least some of the features illustrated above.

Control of fiber modification by at least one pulp refining device on the basis of the control parameter may comprise or be connected to a mechanical refuting controller 322 and/or a chemical treatment controller 324 for implementing at least some of the above illustrated mechanical and/or chemical fiber refining actions. The mechanical refining controller 322 may be a control unit in a mechanical refiner and control for example, adjusting of a blade gap between segments in a refiner, pulp batch into a further or a recurrent refining stage or to a subsequent process stage after the pulp refining, changing of blades of the refiner, dilution water and/or production volume. The chemical treatment controller 324 may control for example, dosage of chemicals.

The apparatus may further comprise one or more user interface (UI) 326 devices, such as a display and input means, such as one or more of a keyboard, a touch screen, a mouse, a gesture input device or other type input/output device. The UI may be configured to display the analyzing results and provide user input for controlling the computing unit. It will be appreciated that various other data related to the monitoring and controlling of refining of fibrous pulp may be displayed and/or controlled via the UI.

Figure 4:
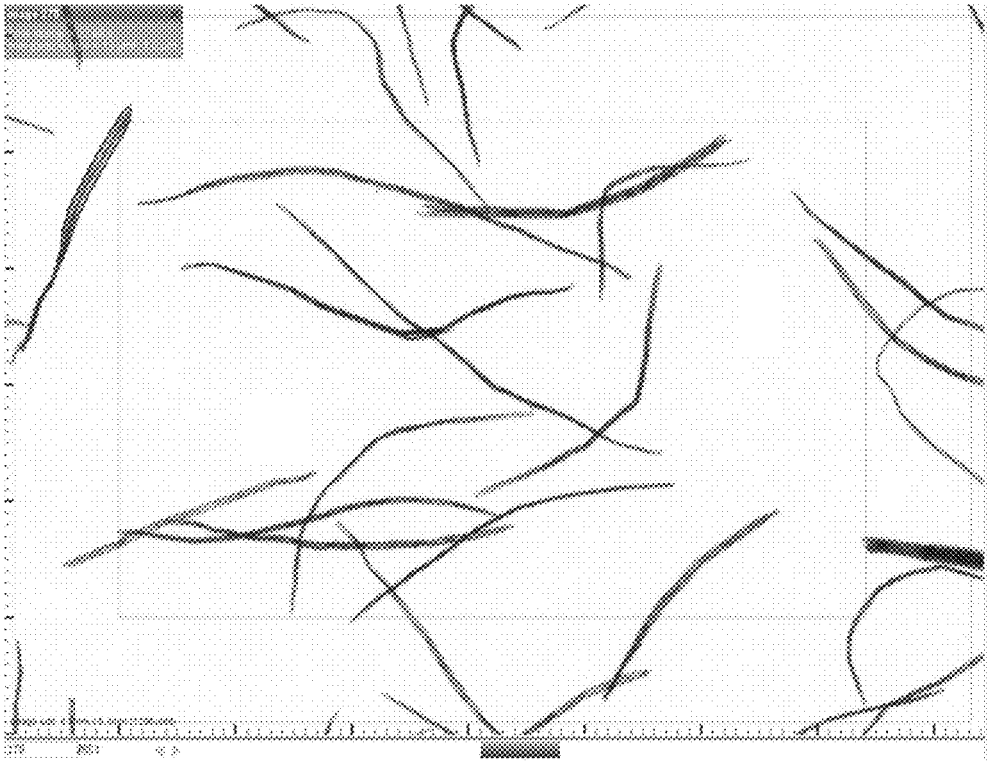
FIG. 4 illustrates fibers in a pulp sample before refining.
Figure 5:
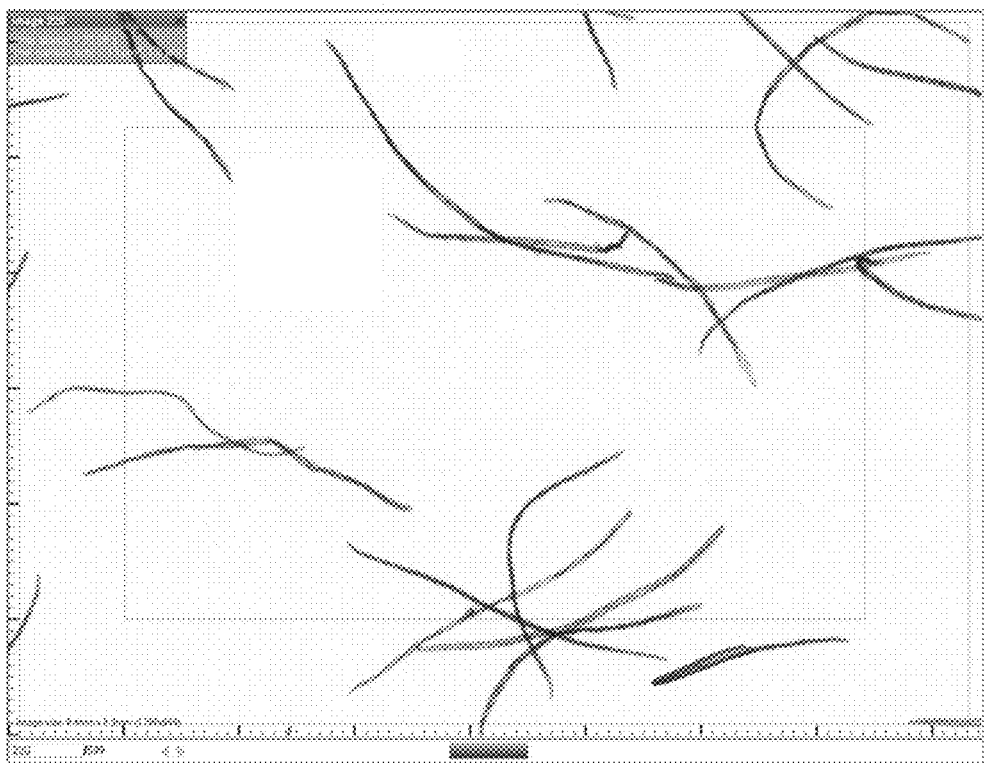
FIG. 5 illustrates fibers in a pulp sample after refining.
Figure 6:
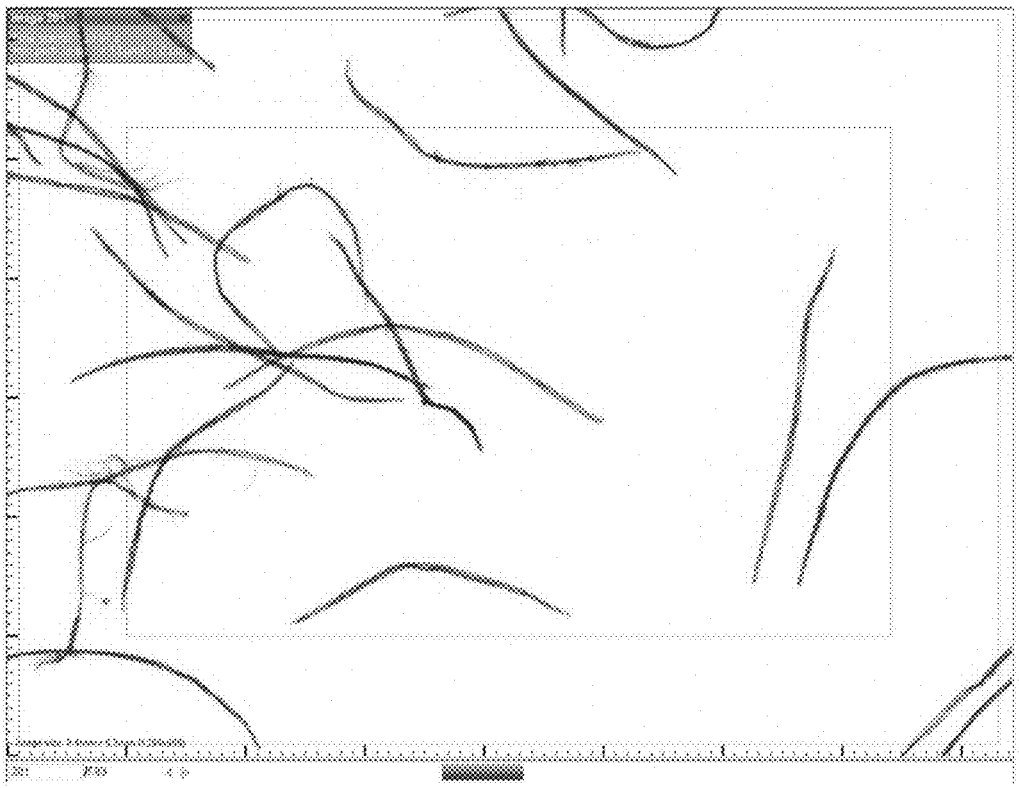
FIG. 6 illustrates fibers in a pulp sample after a second stage of refining.

FIG. 4 illustrates fibers in the pulp sample before refining. Amount of fibrillation is very low. The pulp comprises almost merely plain non-fibrillated fibers. FIG. 5 shows the refined pulp. Fibrillation is seen due to refining effect, but there are still a lot of plain non-fibrillated fibers in the pulp. FIG. 6 illustrates fibers after the second stage of refining. More fibrillation is observed naturally due to further refining. However, there are also non-fibrillated fibers that have passed the refining stages (nearly) without damage.

The present embodiments have several benefits in monitoring and controlling of refining of fibrous pulp. Previous methods for monitoring of the pulp were not sufficient for controlling refining. Instead, the present embodiments give the new fibrillated fibers proportion parameter which can be used to effectively control refining and achieve optimal end product properties. Due to controlling of refining by the new parameter, higher web strength can be achieved by higher fiber to fiber bonding. An optimal relation between fibrillated fibers and non-fibrillated fibers may be achieved by the parameter leading to excellent mechanical properties due to the right amount of the fibrillated fibers and sufficient water removal properties due to the right amount of the non-fibrillated fibers. In addition, better formation of the web, and lower porosity, better printability, higher smoothness and higher gloss of the end product may be achieved. Moreover, chemical dosing strategy and energy consumption can be optimized and strength of the web can be modelled due to controlling of refining by the parameter.

The sum of measured fibrillated fibers and non-fibrillated fibers is all fibers. Thus when any two of the fibrillated fibers, non-fibrillated fibers and all fibers are known, the third term is known.

The fibrillated fibers proportion parameter which can be used as a control parameter is one of or both of:

$$\frac{\text{Amount of measured fibrillated fibers}}{\text{Amount of all measured fibers}} \times 100\%$$

or $$\frac{\text{Amount of measured fibrillated fibers}}{\text{Non-fibrillated fibers}} \times 100\%$$

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and examples of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the following description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The verbs "to comprise" and "to include" are used in this document as open limitations that neither exclude nor require the existence of also un-recited features. The features recited in depending claims are mutually freely combinable unless otherwise explicitly stated. Furthermore, it is to be understood that the use of "a" or "an", i.e. a singular form, throughout this document does not exclude a plurality.

I claim:

1. An apparatus for monitoring and controlling refining of fibrous pulp comprising:

a sample handling unit arranged to take samples of the fibrous pulp;

an imaging module in sample receiving relation to the sample handling unit wherein the imaging unit is configured to capture at least one image of the pulp sample;

a fiber analysis module in pulp sample image receiving relation to the imaging module, the fiber analysis module comprising a fiber detector and a fiber classifier arranged to classify and to count a number of non-fibrillated fibers and a number of fibrillated fibers in the at least one image;

a fibrillation related parameter generator in receiving relation to the count numbers of the fiber analysis module and arranged to generate a control parameter based on a ratio between the number of fibrillated fibers, and the number of non-fibrillated fibers; and at least one of a mechanical refining controller and a chemical treatment controller configured for causing fiber modification based on the control parameter.

2. The apparatus of a claim 1 wherein the fibrillation related parameter generator is configured to determine the ratio between the number of fibrillated fibers, and the number of non-fibrillated fibers by adding the number of fibrillated fibers to the number of non-fibrillated fibers.

3. The apparatus of a claim 1 wherein the fiber classifier is configured to detect fibers and fibrils of fibers in the at least one image of the pulp sample and to classify the detected fiber as a fibrillated fiber in response to fibrils connected to the fiber reaching a predetermined threshold parameter.

4. The apparatus of claim 3 wherein the fiber classifier is configured to detect fibers and fibrils of fibers in the at least one image on the basis of at least one of: determined length of the object, width of the object, and area of the object.

5. The apparatus of claim 4 wherein the fiber classifier is configured to classify the fiber recognized in the at least one image into the non-fibrillated fiber or the fibrillated fiber on the basis of a determined area or a determined circle of the fiber.

6. An apparatus for monitoring and controlling refining of fibrous pulp comprising:

a sample handling unit arranged to take samples of the fibrous pulp;

an imaging module in sample receiving relation to the sample handling unit wherein the imaging unit is configured to capture at least one image of the pulp sample;

a fiber analysis module in pulp sample image receiving relation to the imaging module, the fiber analysis module comprising a fiber detector and a fiber classifier arranged to classify and to count a number of non-fibrillated fibers and a number of fibrillated fibers in the at least one image;

a fibrillation related parameter generator in receiving relation to the count numbers of the fiber analysis module and arranged to generate a control parameter based on a ratio between the number of fibrillated fibers, and a sum of the number of fibrillated fibers and the number of non-fibrillated fibers; and at least one of a mechanical refining controller and a chemical treatment controller configured for causing fiber modification based on the control parameter.

7. The apparatus of a claim 6 wherein the fiber classifier is configured to detect fibers and fibrils of fibers in the at least one image of the pulp sample and to classify the detected fiber as a fibrillated fiber in response to fibrils connected to the fiber reaching a predetermined threshold parameter.

8. The apparatus of claim 7 wherein the fiber classifier is configured to detect fibers and fibrils of fibers in the at least one image on the basis of at least one of: determined length of the object, width of the object, and area of the object.

9. The apparatus of claim 8 wherein the fiber classifier is configured to classify the fiber recognized in the at least one image into the non-fibrillated fiber or the fibrillated fiber on the basis of a determined area or a determined circle of the fiber.

* * * * *